US005540343A

United States Patent [19]

Schumacher

[11] Patent Number: 5,540,343

[45] Date of Patent: Jul. 30, 1996

[54] LOCKING CAP WITH SNAP HINGE

[75] Inventor: Clemens Schumacher, Sundern, Germany

[73] Assignee: Robert Finke GmbH & Co. KG, Finnentrop, Germany

[21] Appl. No.: 504,956

[22] Filed: Jul. 20, 1995

Related U.S. Application Data

[63] Continuation of Ser. No. 126,533, Sep. 23, 1993, abandoned.

[30] Foreign Application Priority Data

Sep. 26, 1992 [DE] Germany ..... 42 32 314.2
Nov. 23, 1992 [DE] Germany ..... 42 39 299.3

[51] Int. Cl.[6] ..... B65D 47/08
[52] U.S. Cl. ..... 215/235; 220/339
[58] Field of Search ..... 215/235, 237; 220/339

[56] References Cited

U.S. PATENT DOCUMENTS

| | | | |
|---|---|---|---|
| 4,334,639 | 6/1982 | Gach . | |
| 4,403,712 | 9/1983 | Wiesinger . | |
| 4,457,458 | 7/1984 | Heinol . | |
| 4,813,560 | 3/1989 | Begley | 215/235 |
| 4,815,616 | 3/1989 | Silvenis | 215/232 |
| 4,854,473 | 8/1989 | Dubach | 220/335 |
| 5,145,646 | 9/1992 | Tyranski | 422/102 |

FOREIGN PATENT DOCUMENTS

| | | |
|---|---|---|
| 0291457 | 11/1988 | European Pat. Off. . |
| 3150493 | 9/1982 | Germany . |

*Primary Examiner*—Allan N. Shoap
*Assistant Examiner*—Christopher McDonald
*Attorney, Agent, or Firm*—Martin A. Farber

[57] ABSTRACT

A locking cap (1) with a snap hinge (4) and that attains a structural solution which is favourable by using a hinge strap that (6) changes into a crosspiece (8) via a thin spot (10).

19 Claims, 11 Drawing Sheets

LOCKING CAP WITH SNAP HINGE

RELATED APPLICATION

This application is a continuation of my application Ser. No. 08/126,533 filed Sep. 23, 1993 now abandoned.

FIELD AND BACKGROUND OF THE INVENTION

This invention concerns a locking cap with a snap hinge with a hinge strap attaching to a free-standing crosspiece on at least one side of the locking cap.

A locking cap of this type is known from German patent application DE-OS 31 50 493 in which the locking cover is not only connected by a middle hinge but also by hinge straps located on both sides of it. The latter form reversible energy accumulators (potential energy storing members) in their direction of action which stress the locking cover after going beyond a dead centre position into the extreme positions, i.e. closing, opening.

With such one-piece extruded locking caps, so-called white fracture results from overstretching of the participating material sections. This is perceived as at least visually disturbing, above all for attractive containers. Depending on the dyeing of the plastic material, there is a glaring colour contrast.

SUMMARY OF THE INVENTION

The objective of this invention is to remedy this and to produce a more structurally protective generic locking cap while even improving the spring behaviour.

As a result of the invention a locking cap of the introductorily-mentioned type is improved optically and functionally. The disturbing white fracturing virtually no longer occurs. This above all also because the hinge straps are no longer stretched so greatly during closing of the hinge cover (right after extrusion). For this purpose the hinge strap changes into the crosspiece via a thin spot. This results in a movement reserve which is extremely flexible and which even includes the free-standing crosspiece. The deforming stress is no longer transferred to the direct vicinity of the hinge strap either, resulting in the advantage described. One can imagine this as comparable to an elastic whipstock with highly elastic connecting lash. In regard to a locking cap with a locking cover and a locking housing, the one-piece extruded locking cap having a snap hinge connecting the locking housing with the locking cover and at least one hinge strap, it is then proposed that the ends of the hinge strap attach to free-standing crosspieces in a graduated recess in the wall of the sealing cover or of the locking housing which can deflect in order to prevent overstretching of the hinge strap. As a result, the free-standing crosspieces rooted in the relevant structural component not only find an outwardly directed outlet in the direction of closing and opening of the locking cover but also an inwardly directed deflection zone. This results in a fairly large movement bridge with increased resistance to deflecting forces in the root areas of the crosspiece itself and a greater movement readiness in the connecting section of the hinge strap. There is no transgression whatsoever, in the sense of a plastic deformation. The spring characteristic is more uniform in general. This also results in the desired uniform spring action. In particular, the springing back into the old, i.e. mould release position, is achieved almost completely. As a rule this is at 180°, i.e. locking cover and locking housing in parallel alignment to their centre lines. A further development is, for example, that the thickness of the thin spot is a fraction of that of the hinge strap. This results in an especially smooth movement transition. The ratio of thin spot to hinge strap can be 1:2 or 1:3. In this regard, it is also advantageous if the thickness of the hinge strap is a fraction of that of a crosspiece. In this case as well there is appropriately a ratio of 1:2 to 1:3 in the above sequence. In addition, an advantageous feature of even independent significance is the fact that the recess producing the free-standing of the crosspiece or crosspieces is closed in the direction of the periphery of the locking cover and/or of the locking housing by means of a membrane. The production of such a diaphragm is no problem at all insofar as injection moulding technology is concerned: the core forming the recess is cut back somewhat in regard to the desired shell surface of the locking cover and/or locking housing. The remaining material bridge between the hinge strap and shell wall even increases the spring force of the hinge strap, in other words it even increases further the spring force in the alternating directions. Such a membrane is circa 0.2 mm thick and virtually has a plastic-sheet-like mobility itself. The membrane also prevents dirt accumulations. An additional advantageous feature of the structure-protecting design is that the width of the hinge strap, which is thickened compared to a thin spot, decreases continuously to a very narrow space between the hinge components (viewed in the open state) while essentially retaining the difference in thickness. This no longer concentrates the formation of a geometric axis in a specific narrow area, rather the difference in thickness results in a partial stiffening there which, starting from the hinge straps forming the actual spring elements, continues into the middle hinge. In this case the result is a distribution of the folding zones of the hinge. This results in an even more advantageous "floating" hinge spot which virtually regulates itself insofar as forces are concerned and which prevents partial maximum stresses. In this way, any unfavourable tolerance pairings or minor injection moulding deviations are even compensated very satisfactorily. In this regard virtually no spoilage at all results. It is also advantageous that the hinge straps have an almost triangular cross-section in the area of the narrowest clearance. This stiffening rib, which is triangular in cross-section and sits on the hinge strap, represents no problem at all from an injection moulding viewpoint. Its exposed position disappears into existing cavities of the locking cap because in the end the triangular point points to the interior of the locking cap when the latter is closed.

BRIEF DESCRIPTION OF THE DRAWINGS

With the above and other and other advantages in view, the present invention will become more clearly understood in connection with the detailed description of preferred embodiments, when considered with the accompanying drawings.

The drawings show that the invented art of the white-fracture-free hinging can be used even for the middle hinge by selecting in this case a design which, however, is more appropriate to the hinge function.

The drawings show as follows:

Figure 1:
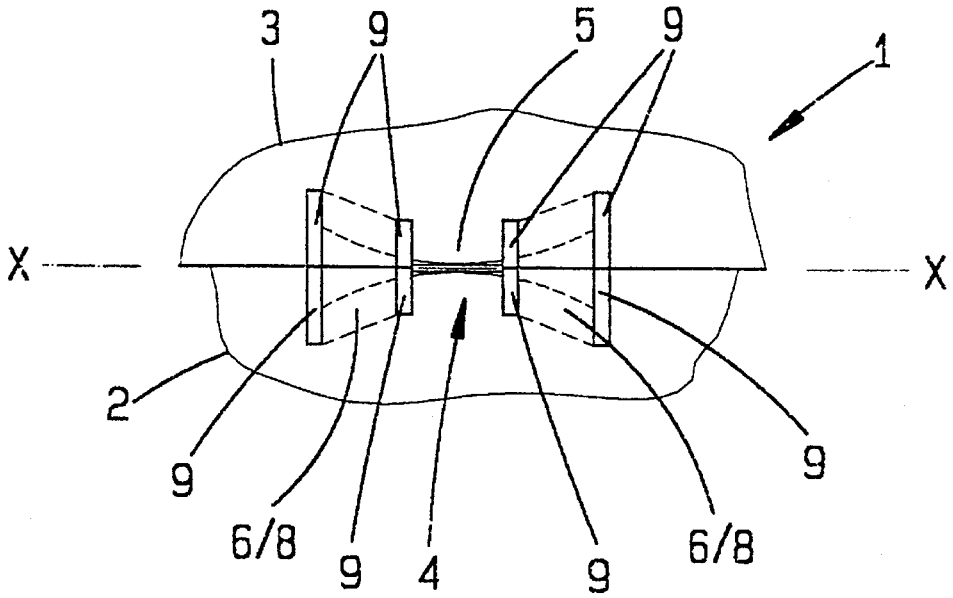
Figure 2:
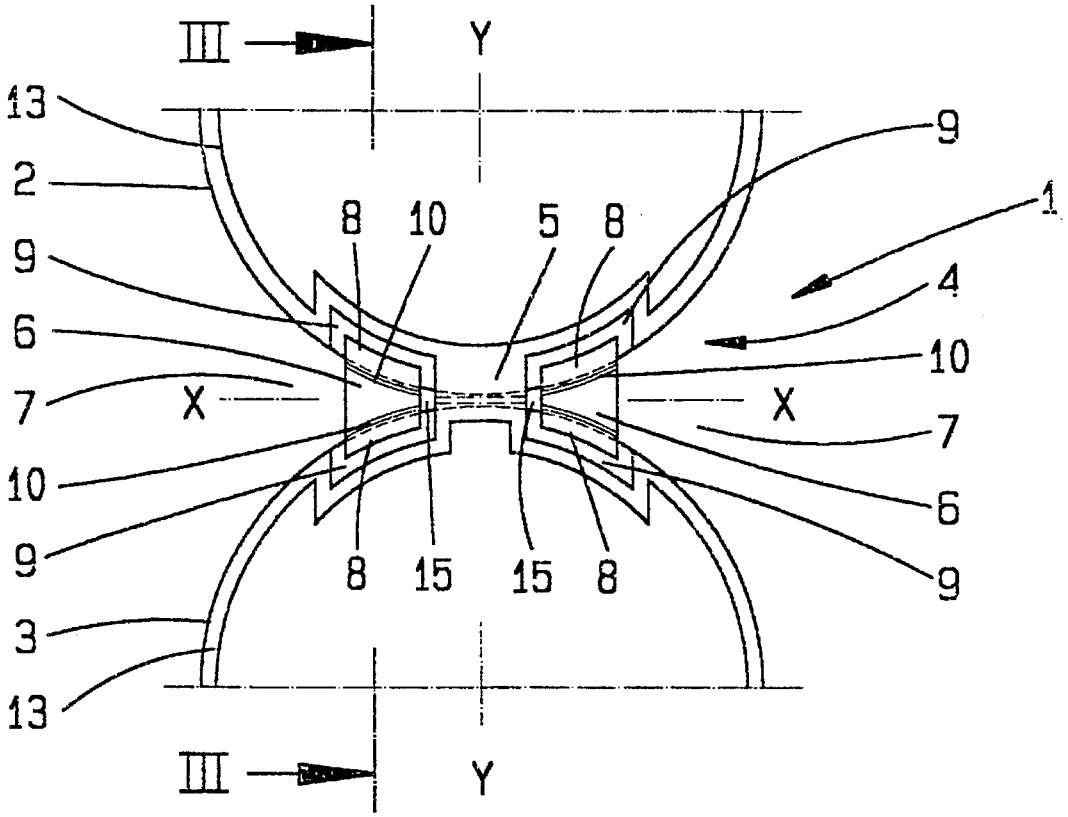
Figure 3:
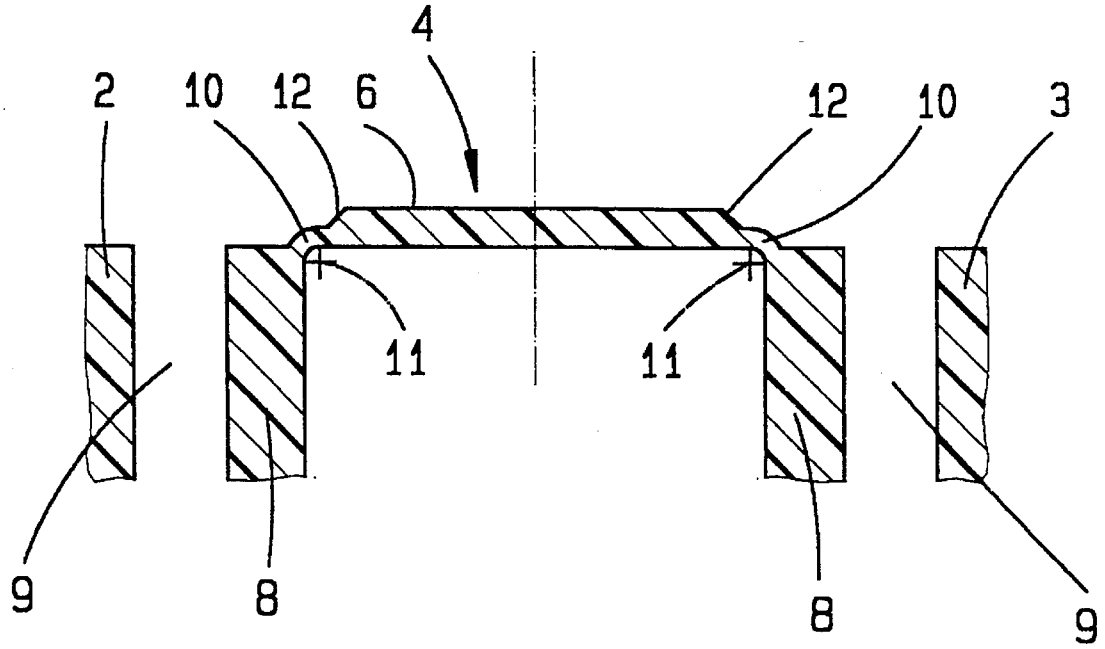
Figure 4:
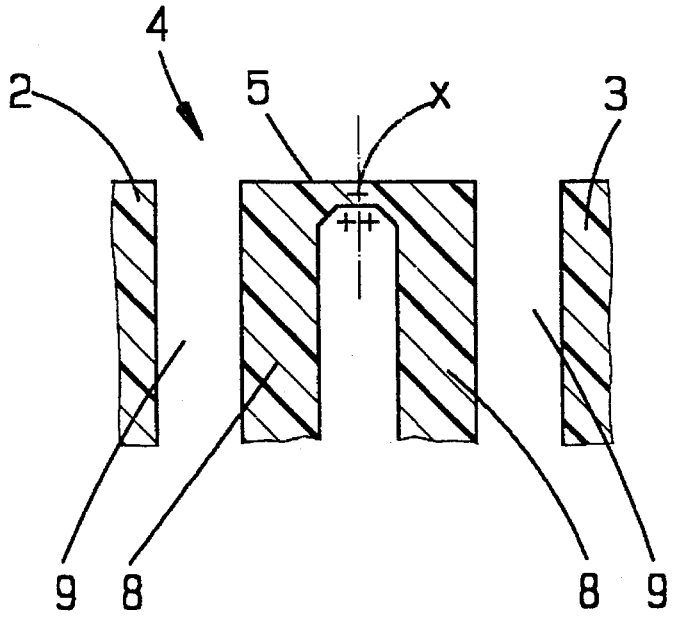
Figure 5:
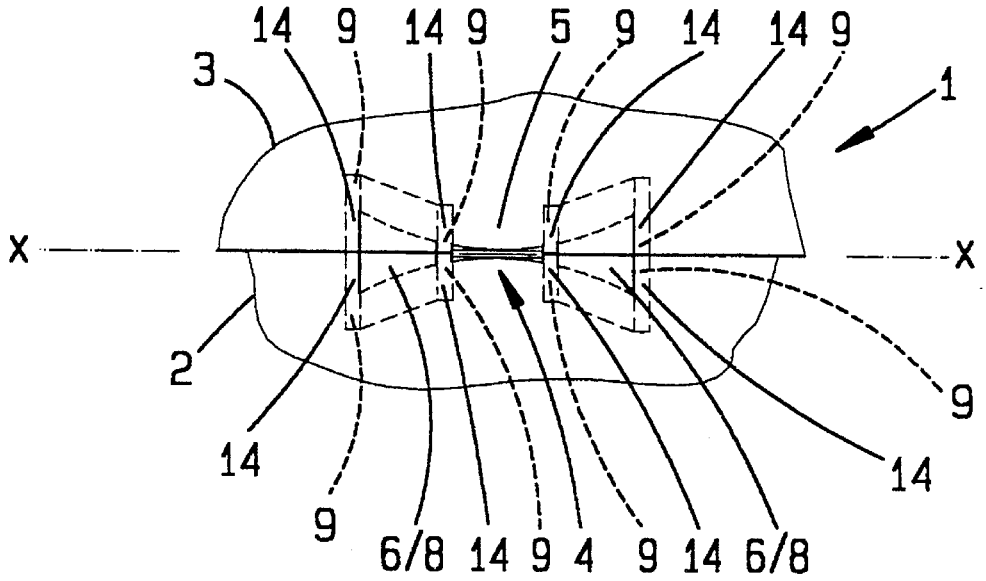
Figure 6:
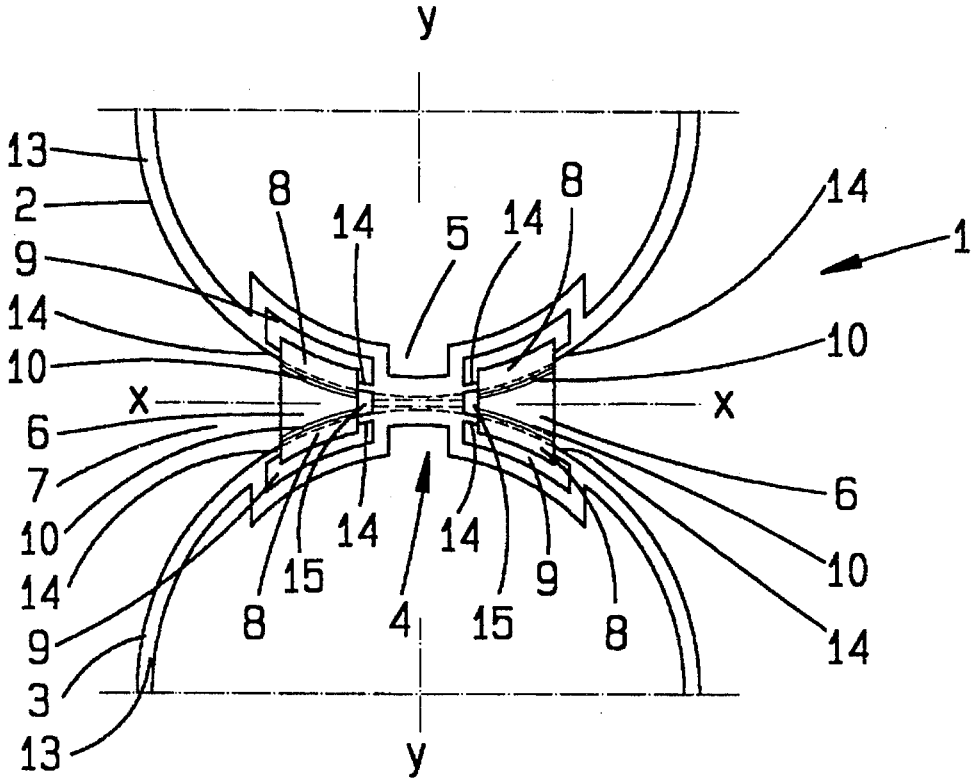
Figure 7:
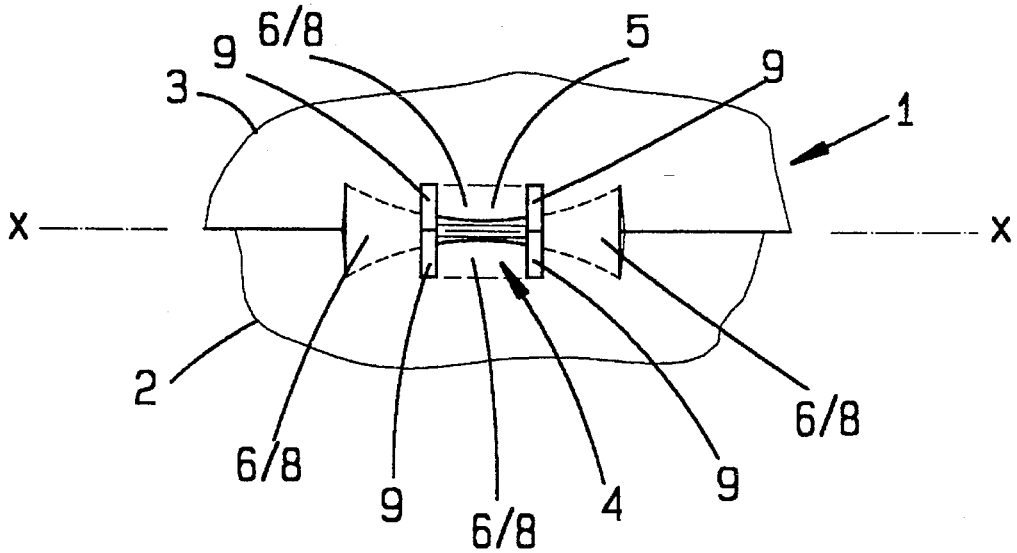
Figure 8:
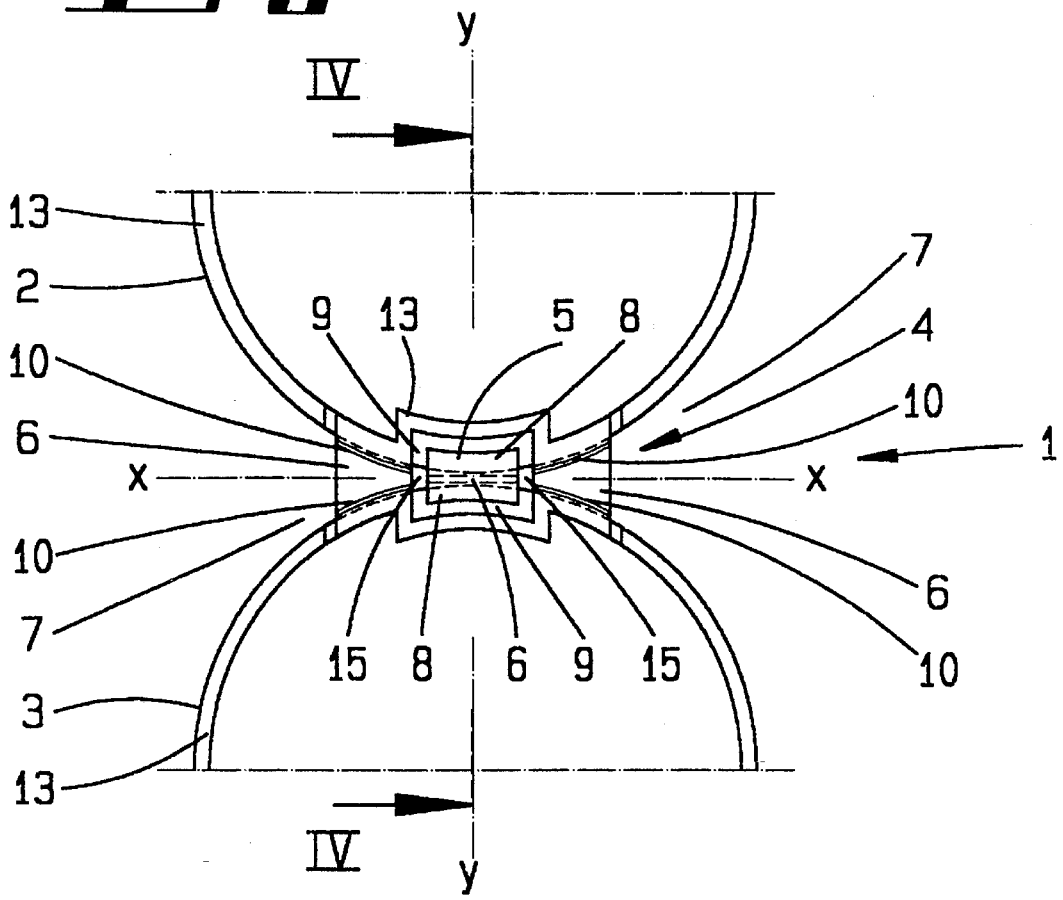
Figure 9:
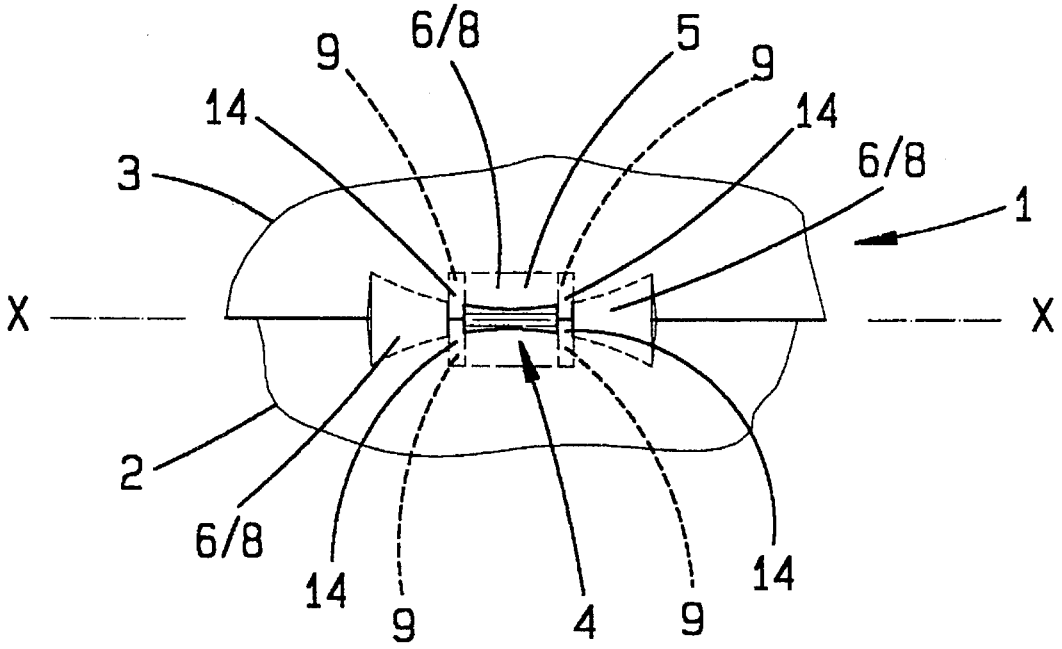
Figure 10:
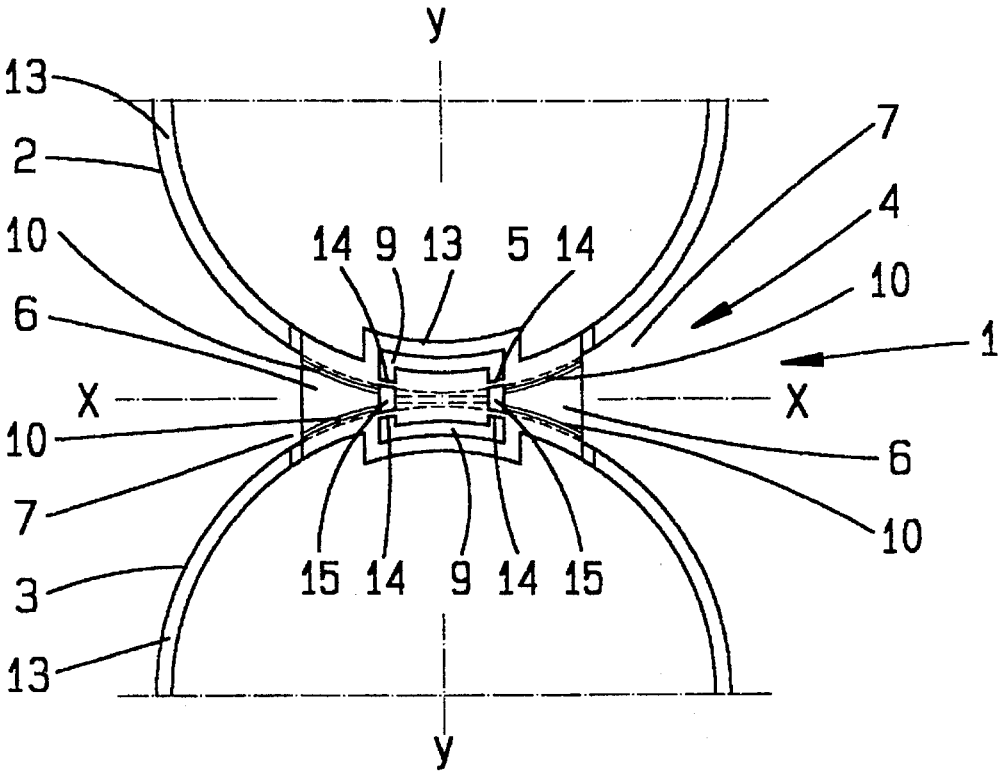
Figure 11:
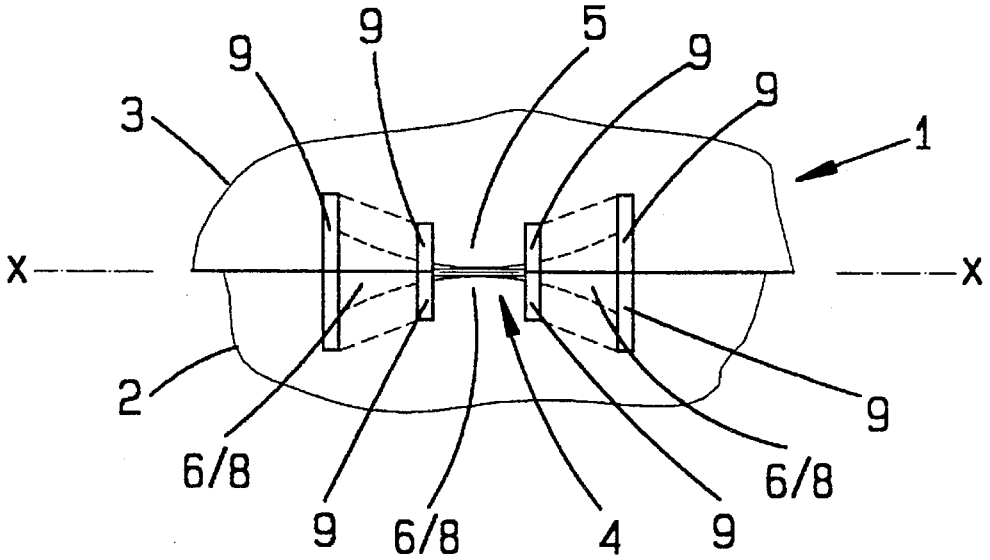
Figure 12:
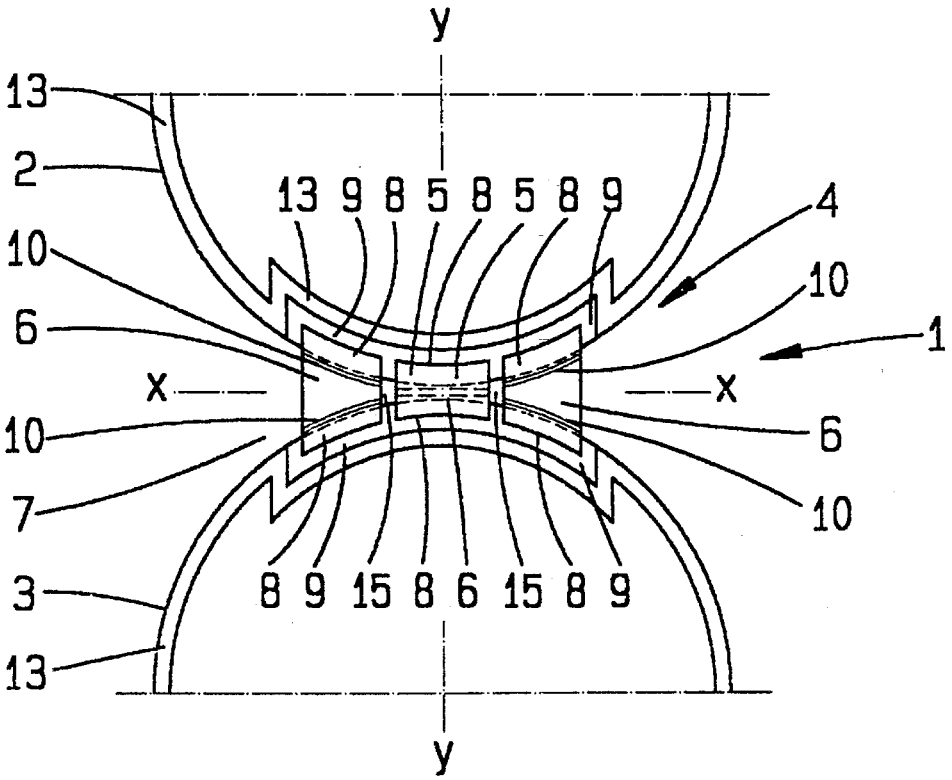
Figure 13:
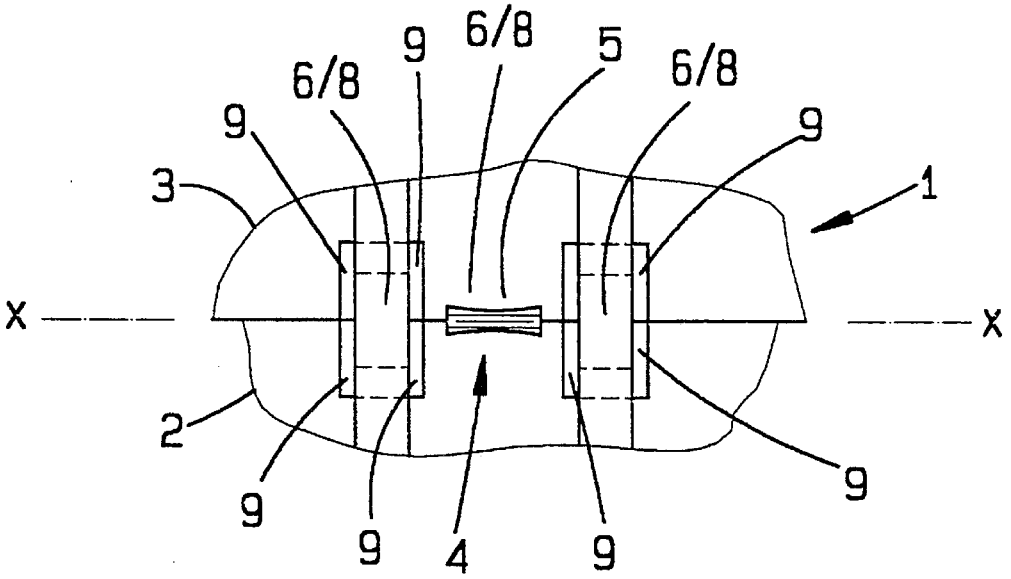
Figure 14:
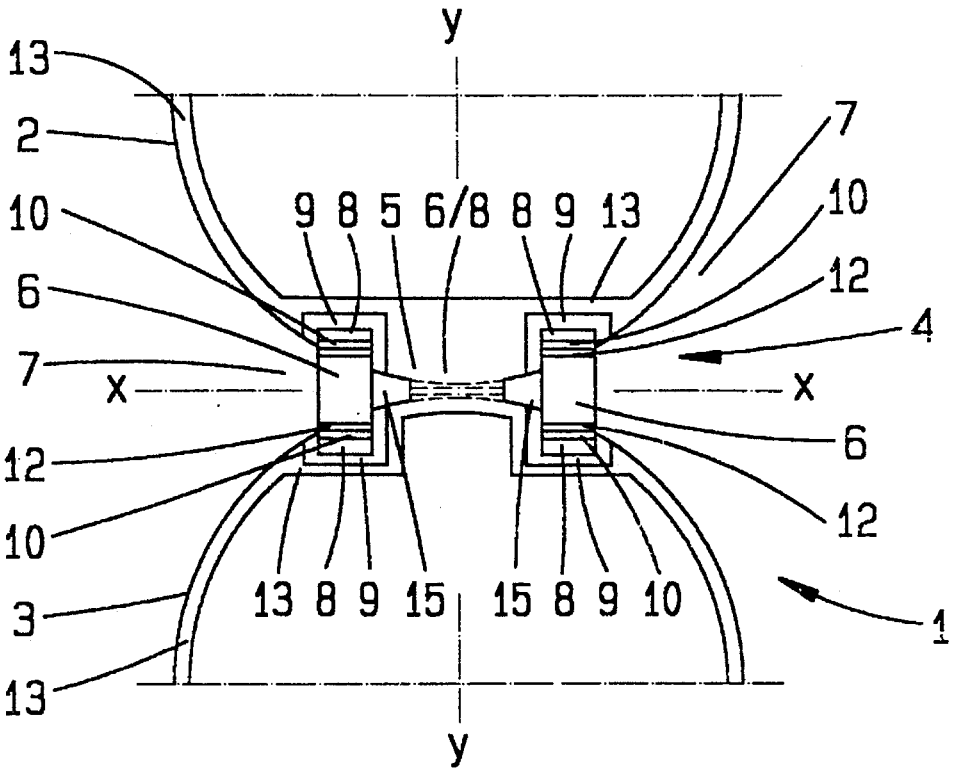
Figure 15:
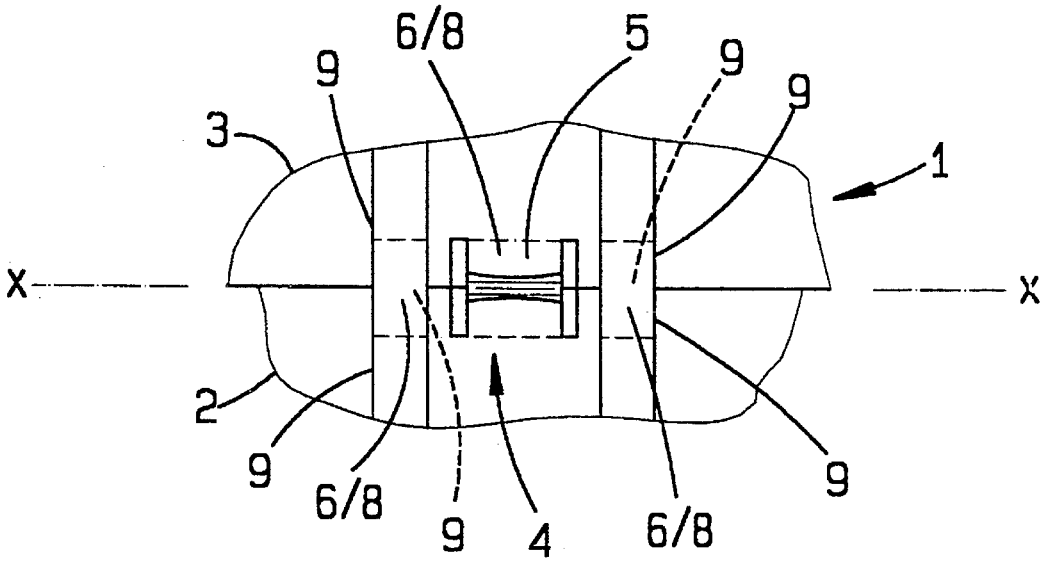
Figure 16:
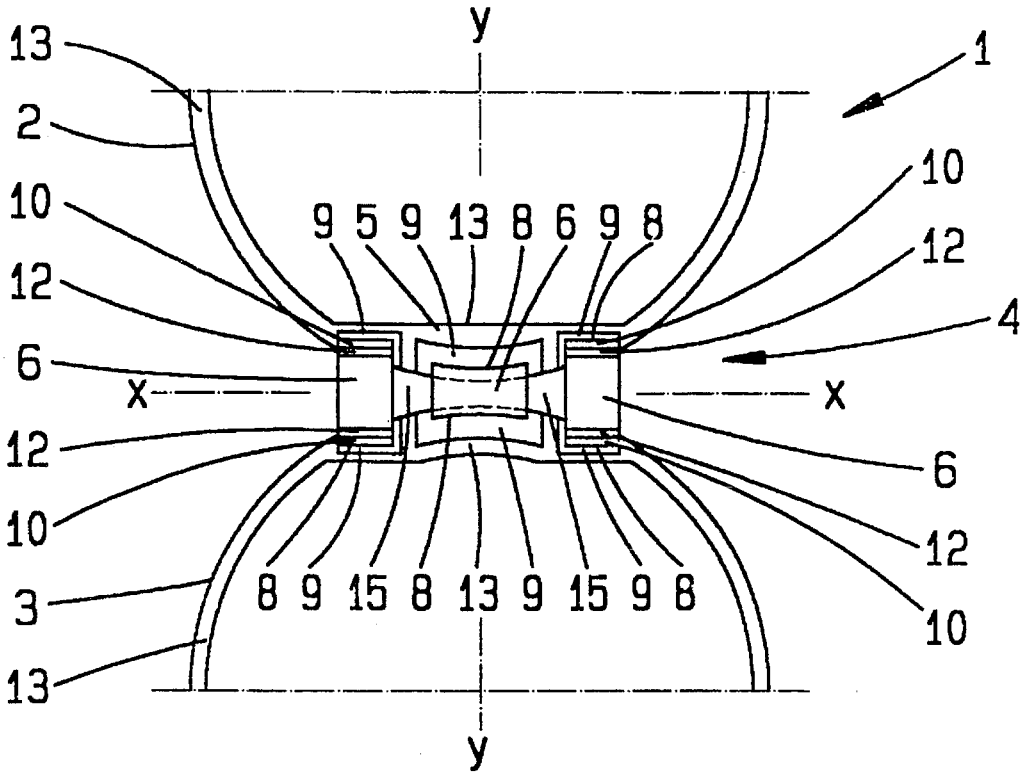
Figure 17:
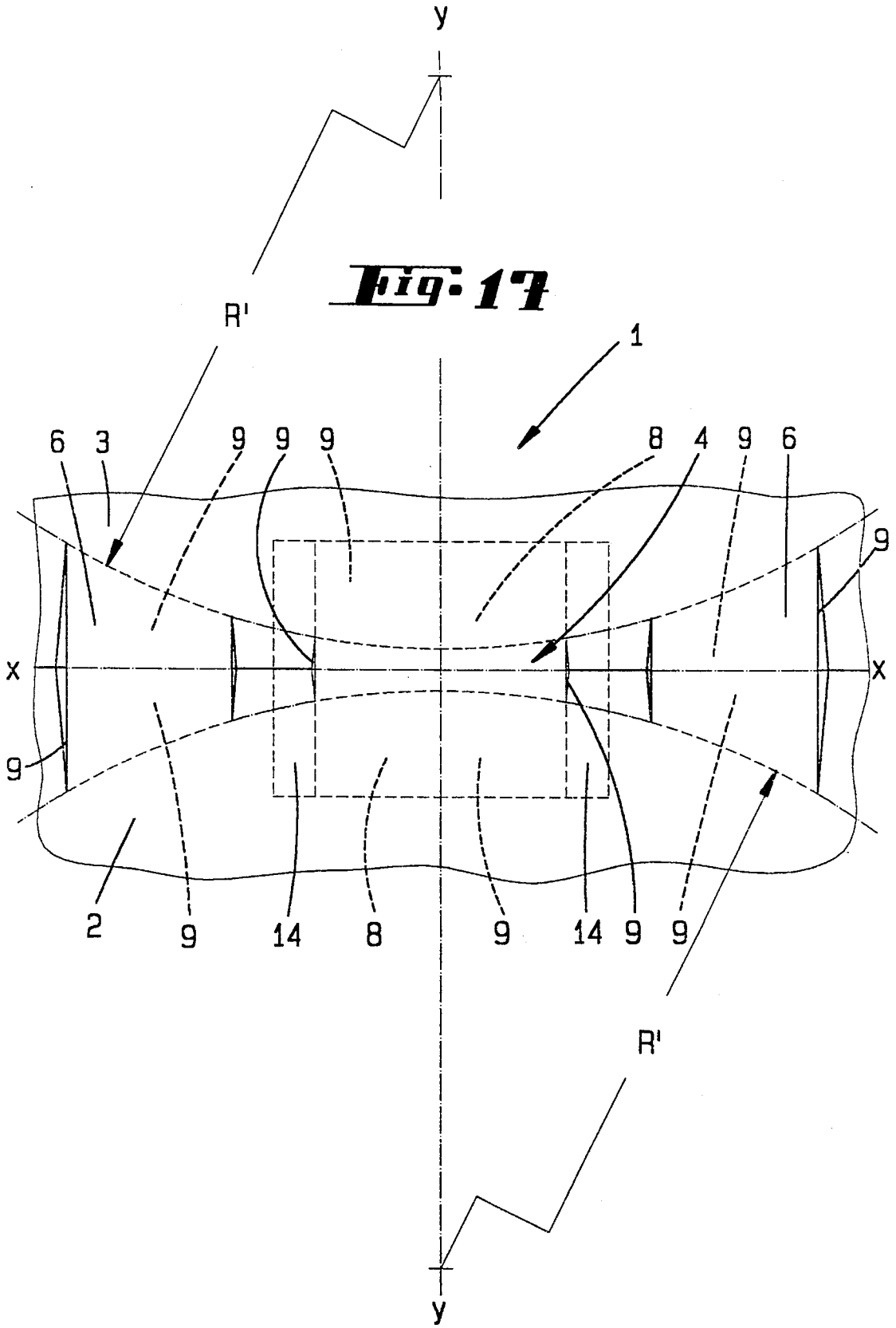
Figure 18:
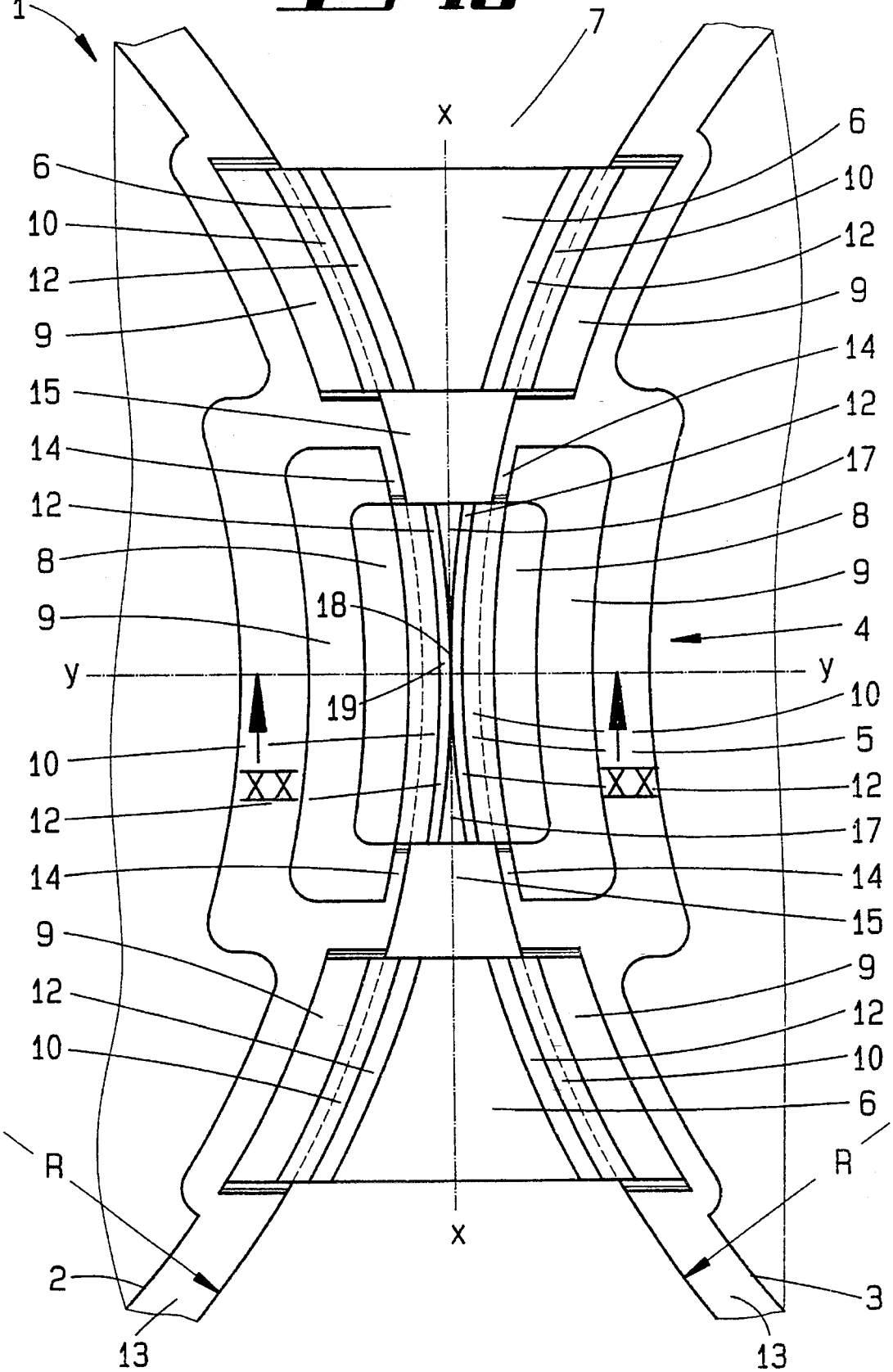
Figure 19:
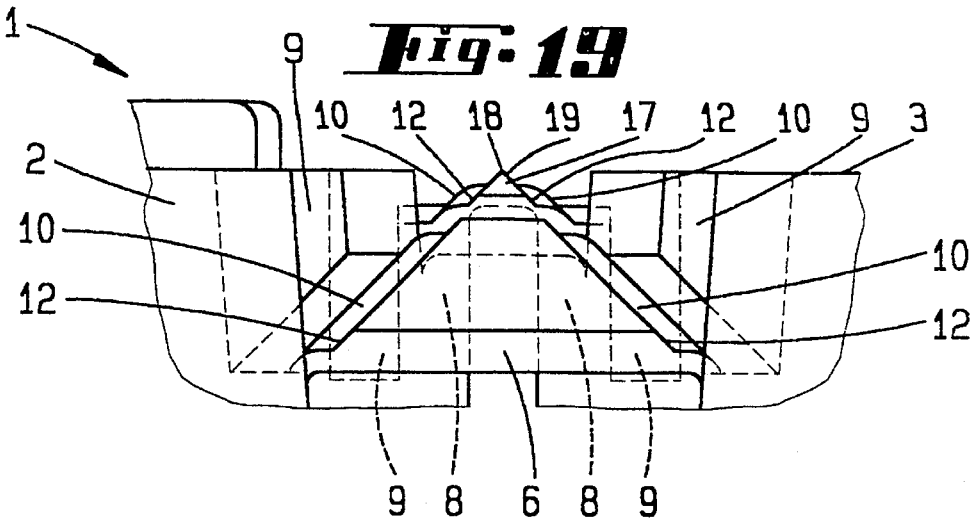
Figure 20:
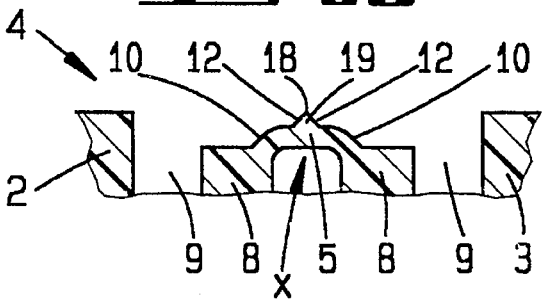
Figure 21:
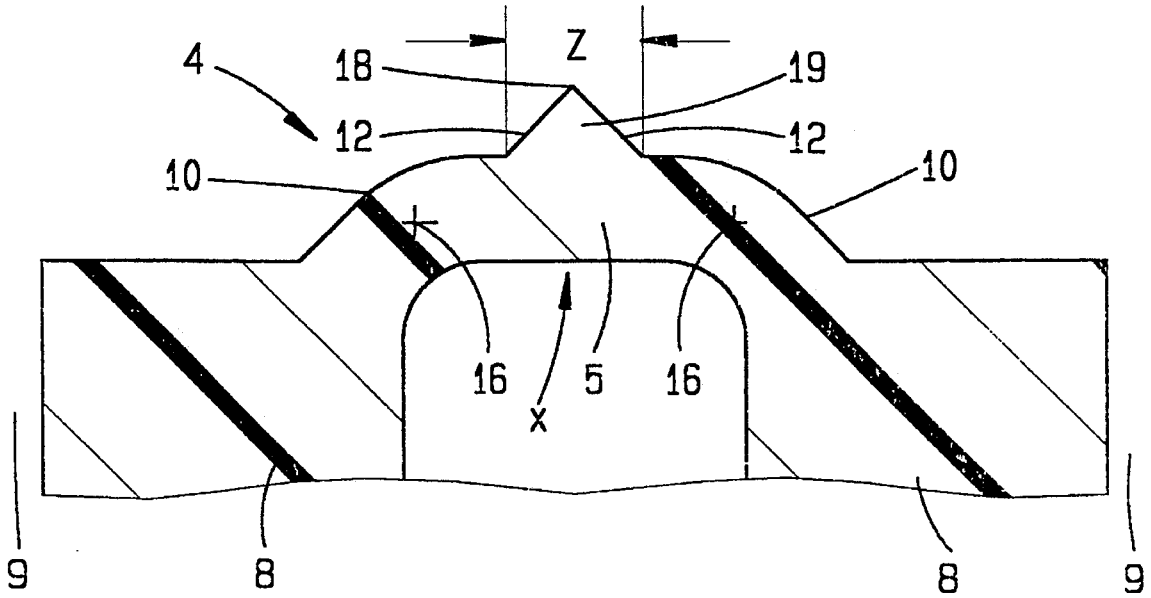

FIG. 1 a partial reproduction of the inventive locking cap in accordance with the first embodiment and specifically viewed against the snap hinge, externally sprung, with open recess, the locking cover being closed, FIG. 2 top view of this locking cap with the locking cover open in the 180° position, the recess illustrated as U-shaped grooves, FIG. 3 a section taken along Line III—III in FIG. 2 greatly enlarged, FIG. 4 a section taken along Line IV—IV in FIG. 8 also greatly enlarged, FIG. 5 the inventive locking cap in accordance with the second embodiment, illustrated as in FIG. 1 but with a recess closed by a membrane, FIG. 6 the top view of this in the same position as in FIG. 2, FIG. 7 the inventive locking cap in accordance with the third embodiment, illustrated as in FIG. 1 but sprung in the middle and with an open recess, FIG. 8 the top view of the above, once again illustrated as in FIG. 2, FIG. 9 the inventive locking cap in accordance with the fourth embodiment, illustrated as in FIG. 1, specifically as a development of the third embodiment such that in this version the recesses are closed by a membrane, FIG. 10 the top view of the above, FIG. 11 the inventive locking cap in accordance with the fifth embodiment, illustrated as in FIG. 1, the two laterally located hinge straps, in addition to the middle hinge, also being sprung; consequently, a continuous recess is achieved which is not closed however, FIG. 12 the top view of the above which reproduces these facts even better, FIG. 13 the inventive locking cap in accordance with the sixth embodiment illustrated as in FIG. 1, sprung externally, i.e. in the area of the hinge straps, but with a straight connection and not with a butterfly-shaped one as with the preceding embodiments and with an open recess, FIG. 14 the top view of the above, FIG. 15 the inventive locking cap in accordance with the seventh embodiment, illustrated as in FIG. 1, with middle hinge springing and lateral external connection, once again via straight hinge straps, FIG. 16 the top view of the above, FIG. 17 the inventive locking cap in accordance with the eighth embodiment, illustrated as in FIG. 1, with middle hinge, springing, and lateral connection via hinge straps, greatly enlarged, FIG. 18 the top view of the above, enlarged further, but with the locking cap open, FIG. 19 a view in direction A in FIG. 18, FIG. 20 a section taken along Line XX—XX in FIG. 18, and FIG. 21 a further enlargement of this section.

DETAILED DESCRIPTION OF THE PREFERRED EMBODIMENT

The locking cap 1 attached to a container which is not illustrated is made of plastic, preferably PP. The attachment can be screw-like in nature; an impinging or a direct moulding of the container is also possible.

Components of the locking cap 1 are an essentially cylindrical locking housing 2 with a one-piece, preferably circular, locking cover 3 which is extruded onto the former. The locking cover 3 is pot-shaped and can have a centrally or decentrally positioned stopper element which seals tightly a congruent opening of a discharge socket in the cover of the locking housing 2 (not illustrated).

The snap hinge 4 designed as a film hinge is located in the area of a tangent of the two structural components forming the locking cap 1.

The snap hinge 4 consists of a so-called middle hinge 5 and, positioned laterally to this, two external tension bands designated as hinge straps 6. Therefore the middle hinge 5 and hinge straps 6 form a wedge-shaped gap 7 between the overlapping material bridges connecting the two components. Reference is made to FIGS. 2 to 4 for example. The material bridge illustrated in FIG. 4 is relatively short but broader than the thickness measured in the vertical plane. Consequently, the "hinge axis formation" of this flap-like bridge zone has a certain ability to adjust itself. It forms the geometric hinge axis x—x. This bridge is considerably longer in the area of the hinge straps 6, as FIG. 3 shows, and, in addition, is also evident from the top views, such as FIG. 2.

Both the material bridge of the middle hinge 5 as well as the material bridge forming the hinge straps 6 exit from free-standing crosspieces. The latter run spacially parallel to the longitudinal middle axis of the rotation-symmetrical structural components, i.e. the locking housing 2 and locking cover 3. The crosspieces 8 have a small cross-section and are curved, in the main slightly, in the direction of the circumference. They are several millimeters long.

All crosspieces 8 are rooted in a graduated recess 9. The recess 9 is of such a width, above all in the radial direction, that the free-standing crosspieces 8 can deflect in a whiplash manner in response to the hinge forces. In addition, there is the even greater flexibility of the sections of the middle hinge 5 which form the bridge or which help form the film hinge respectively and those of the hinge straps 6. The result of this is that there is almost no more so-called white fracture at all. The locking cap retains its production-fresh appearance. The entire container remains attractive.

The free-standing crosspieces 8 form a flexible resistance to the closing and opening forces of the snap hinge 4. They have their greatest stationary stability in the root area of the graduated recess 9 which, however, increasingly changes into a flexible end zone to which the hinge straps 6 then attach like a whiplash. If supplementary forces occur perpendicular to the graduated recess 9, they flow into the entire bending reserve, which effectively prevents an overstretching of the hinge straps, which can deflect outwards.

The thickness of the hinge straps 6 is a fraction of the thickness of the crosspiece 8. The hinge strap 6 is approximately half as thick as the related crosspiece or crosspieces 8. The hinge strap 6 connects to at least one crosspiece 8.

Either way, it is advantageous in any case that the hinge straps 6 change into the crosspiece or crosspieces 8 via an intermediate thin spot 10. This thin spot 10 is shown especially clearly in FIG. 3. The thickness of the thin spot 10 is approximately a fraction of that of the hinge strap 6. In the embodiment illustrated the thin spot 10 is approximately half as thick as that of the hinge straps 6 which form the material bridge and embody the external springing of such snap hinges 4.

The thin spot 10 is convex in the release position of the injection moulding article illustrated in FIG. 3. The radius point located in the area of the angle bisector between the hinge strap 6, which is horizontal in this area, and the vertically arranged crosspiece 8 bears the reference number 11. The inner and outer crown of the definitely curved thin spot 10 run parallel. Whereas the outer curve runs relatively steeply into the upper front edge of the crosspiece 8, the other end of this curve changes into a stress-concentration-avoiding flank 12 towards the upper side of the hinge strap 6. The slope of this flank 12 is 45° to the horizontal extension of the hinge strap 6.

The recess 9 both of the crosspieces 8 of the middle hinge 5 as well as of the hinge straps 6 is formed by U-shaped grooves in each case which exit from the upper front end of the relevant component. The width of the groove corresponds throughout, i.e. also in the area of its U-legs, to the thickness of the crosspieces 8 or to the thickness of the wall 13 of the locking housing 2 and locking cover 3. Therefore the wall 13 is offset in the area of the recess 9. This offset is directed inwards so that the cylindrical shell wall of both components, i.e. the locking housing 2 and of the locking cover 3, can remain cylindrical. The wall 13 of the locking housing 2 is, as is especially evident from FIG. 17, somewhat thicker than that of the locking cover 2. It can also be concluded from FIG. 17 that the wall edges are rounded and smoothed off to help the injection moulded article to release more easily. The floor of the recesses 9 as well as all other corners and edges are rounded and smoothed off in the same way.

The crosspiece 8 of the recess 9, which crosspiece is adapted to the curvature of the shell wall of the components mentioned, extends behind the hinge straps 6 providing the lateral springing in the first and second embodiments; however in the third embodiment they are located behind the crosspieces 8 which proportionally form the middle hinge 5. In this case the central springing operates.

On the other hand, the fifth embodiment shows a mixed form, i.e. the recess 9 extends continuously both behind the crosspieces 8 of the middle hinge 5 and behind the crosspieces 8 of the hinge straps 6 located laterally to them. As a result, the snap hinge 4 has a total of six springing legs formed by the crosspieces 8, three per component.

The sixth and seventh embodiments are distinguished merely by the fact that the recesses 9 and crosspieces 8 are not oriented butterfly-like in accordance with the curvature of the cylindrical shell wall but produce in the shortest way, by bridging the gap, the connection to the two components via folds parallel to the axis x—x. Therefore there are spatially parallel straight connections or rather straight hinge straps 6.

In each case the reference numbers are used here analogously.

In the seventh embodiment, however, with regard to the middle hinge 5 the curvature of the recess 9 and of the crosspieces 8 is in the same direction as described above. Only the external recesses 9 open parallel to the closing and opening level y—y of the locking cap 1.

In order to eliminate an unattractiveness associated with the recess 9 where the plastic is dyed specific colours, the recesses 9 can be closed towards the outside, i.e. in the direction of the shell wall of the locking cap 1. This is realized in the case of some of the embodiments illustrated but can also be applied in all solutions. In concrete terms the procedure has been that the recess 9 producing the described self-supporting of the crosspiece or crosspieces 8 is closed in the direction of the periphery, i.e. shell surface of the locking cover 3 and/or of the locking housing 2, via a membrane 14. The thickness of the latter is circa 0.2 mm. It closes the front ends of the U-legs of the U-shaped recess 9, which point to the outside, by forming a diaphragm. Such a shell-wall-closing material bridge is highly flexible. In addition, it is a positive assistance in accordance with the desired springing. Furthermore, an opening separates the material bridges forming the hinge straps 6 from the material bridge forming the middle hinge 5.

The achieved high springing back of the features producing the springing result in the locking cover 3 springing back into a position approaching the 180° mould release position. On the other hand, the spring forces operate to a high degree in the direction of the closed position of the locking cap 1 as a result of the excess dead centre position.

The eighth embodiment reproduced in FIGS. 17 to 21 also embodies the basic principle described above in detail. Therefore, the reference numbers are applied analogously, in part without the text being repeated. The main development of this solution is that the width of the hinge straps 6 which are thickened in comparison to the thin spots 10 continuously decreases to a very narrow space z between the hinge components 6 (compare open position in FIG. 18). In doing so they essentially retain the difference in thickness, measured vertically, to the thickness of the aforesaid thin spots 10.

As a result the material bridge forming the geometric hinge axis is partially, i.e. in the middle area, reinforced. This results in two folding centres in the said thin spots 10. These folding centres bear the reference number 16 and are located (horizontally in the open position) in the narrowest neighbouring position, virtually double-axis-forming, in the centre of gravity path of the thin spots 10 curved convex upwards. During closing, competing or offsetting forces result which support the spring behaviour but which, on the other hand, are absorbed in a manner which protects the structure. The closing locking cover virtually feels itself into the correct seat. Of the total 180° closing angle, the folding share allocated to each thin spot 10 is 90°. This protects the structure and increases the service life.

In addition, as the middle hinge 5, corresponding to the mentioned butterfly-like design of the snap hinge 4, changes, together with the hinge straps 6, into a distinct curve, common resetting forces also originate here which can be utilized in a most favourable manner. The course of the curve can be seen especially clearly from FIG. 19, viewed in this case from the side from which the curve is seen as rising (view in direction A). The crown zone of the thickening of the hinge strap 16, which reaches its highest position in the open position on the closing hinge 4, or stated more precisely on the middle hinge 5, closes at the same level with the joint-forming lateral edge of the walls 13 of the locking housing 2 and the locking cover 3.

With this eighth embodiment as well, the described opening 15 is located between the middle hinge 5, which is attached at the top to the crosspieces 8, which are described in detail, via the thin spots 10 and the external hinge straps 6 forming spring elements.

In top view FIG. 18 the thickening of the hinge straps 6 compared to the thin spots 10 appears as a trapezoidal plateau which is continuously tapering off in the direction of the closing level y—y. This trapezoidal plateau then connects to the front ends of the middle hinge 5 in correspondence with the form but then, with further reduction in the plateau-triangle surface 17 which tapers into a point in the direction of y—y, runs out into a common point 18 of a rib 19 which is triangular in cross-section. The triangular rib 19 can be equilateral. This means that the one side roots in the upwardly convex, opposing, level external surface parts of the thin spots 10. On the other hand, the other sides of the triangle are the extensions of the flanks 12 leading to the cross-sectional trapezoid.

With the locking cap 1 closed, the free triangular point 18 points towards the interior of the locking cap. There it fits into a clearance space, which exists in any case, formed proportionally by the recesses 9. When closed, virtually none of the hinge mechanics is visible on the exterior of the locking cap 1. In this case not even the U-leg sections of the recesses 9 are visible, because in this eighth embodiment the membranes 14 closing them are taken into account.

Instead of, as in the eighth embodiment, only the material bridge producing the middle hinge 5 connecting to the vertical crosspieces 8 in a deflection-enhancing manner, the hinge straps 6 could also, as can be reconstructed from the preceding embodiments, be rooted in such free-standing crosspieces 8 whose background has the described recess 9.

The entire hinge zone extends over the shell or circumferential length of the cylindrical locking cap 1 which corresponds approximately to the radius R of the same. In this regard the radius R' of the counter-concave curves, defined by the thin spots 10, which produce the butterfly-like structure also corresponds approximately to the radius R. The illustrated closing hinge can also have a non-circular, or rather oval, cross-section.

The crosspieces 8 referred to throughout this specification are in the nature of legs or pedestals.

I claim:

1. A one-piece, extruded locking cap comprising a locking cover, a locking housing, and a snap hinge connecting the locking housing with the locking cover;

wherein the cover has a wall and the housing has a wall, at least one of said walls of said cover and said housing defining a graduated recess;

said snap hinge comprises a free-standing crosspiece located at said graduated recess; and said snap hinge further comprises a film element connecting with said crosspiece and bridging from said cover to said housing, said film element having an end with a thin region characterized by a thickness less than a nominal thickness of the film element, said thin region serving to attach the film element to said crosspiece, and wherein said crosspiece is bendable to avoid an overstretching of the film element.

2. The locking cap in accordance with claim 1, wherein said snap hinge further comprises a second hinge section and a third hinge section, and said film element is a middle hinge located between said second hinge section and said third hinge section.

3. The locking cap in accordance with claim 1, wherein said film element is a hinge strap.

4. The locking cap in accordance with claim 1, wherein said snap hinge further comprises additional film elements, one of said film elements is a middle hinge located between said additional film elements, and another of said film elements is a hinge strap.

5. The locking cap in accordance with claim 1, wherein a thickness of said film element is smaller than a thickness of said crosspiece.

6. The locking cap in accordance with claim 1, further comprising a membrane in said cover extending from said cover wall and a membrane in said housing extending from said housing wall; and wherein said recess is closed in directions of the peripheries of the cover and the housing respectively by said membranes of the cover and the housing, respectively.

7. The locking cap in accordance with claim 1, wherein said graduated recess is a first recess of a plurality of recesses and is located in said housing, said plurality of recesses includes a second recess located in said cover, said free-standing crosspiece is a first crosspiece of a plurality of free-standing crosspieces and is located at said first recess, said plurality of crosspieces includes a second crosspiece located at said second recess; and said film element extends from said first crosspiece to said second crosspiece, and a width of the film element decreases continuously to a central region midway between said first and said second crosspieces.

8. The locking cap in accordance with claim 7, wherein said film element has approximately a triangular cross-section in said central region.

9. The locking cap in accordance with claim 8, wherein a triangular point of said triangular cross-section points to an interior of said locking cap in an open condition of said cap.

10. The locking cap in accordance with claim 1, wherein said recess is in the cover.

11. The locking cap in accordance with claim 1, wherein said recess is in the housing.

12. A unitary, extruded, hinged cap comprising:

a cover, a housing, and a hinge connecting said housing with said cover;

wherein said cover has a wall and said housing has a wall, at least one of said walls of said cover and said housing defining a recess;

said hinge comprises a pedestal located at said recess, said pedestal being separated from one of said walls defining said recess; and said hinge further comprises a film element connecting with said pedestal and bridging from said cover to said housing, said film element having an end with a thin region characterized by a thickness less than a nominal thickness of the film element, said thin region serving to attach the film element to said pedestal, and wherein said pedestal is bendable to avoid an overstretching of said film element.

13. The hinged cap in accordance with claim 12, wherein a thickness of said film element is smaller than a thickness of said pedestal.

14. The hinged cap in accordance with claim 12, further comprising a membrane closing said recess, said membrane having a thickness less than a thickness of said pedestal and extending from said pedestal to said one wall which defines said recess.

15. The hinged cap in accordance with claim 12, wherein said recess is a first recess of a plurality of recesses and is located in said housing, said plurality of recesses includes a second recess located in said cover, said pedestal is a first pedestal of a plurality of pedestals and is located at said first recess, said plurality of pedestals includes a second pedestal located at said second recess, said second pedestal being separated from the wall of said cover; and said film element extends from said first pedestal to said second pedestal; and a width of said film element decreases continuously to a central region midway between said first and said second pedestals.

16. A unitary hinged cap comprising:

a first element, a second element, and a hinge connecting said first element with said second element, one of said elements being a cover and the other of said elements being a housing;

wherein said first element has an encircling wall, a portion of said wall defining a recess;

said first element has a pedestal standing in said recess and spaced apart from said wall;

said hinge comprises a film element extending from said pedestal to said second element, said film element having an end region characterized by a thickness less than a nominal thickness of said film element, said end region serving to attach said film element to said pedestal; and said pedestal is bendable to avoid an overstretching of said film element.

17. A cap according to claim 16, further comprising a membrane closing said recess, said membrane having a thickness less than a thickness of said pedestal and extending from said pedestal to said wall.

18. A cap according to claim 16, wherein said wall of said first element is a first wall, said recess of said first element is a first recess, and said pedestal of said first element is a first pedestal;

said second element has a second encircling wall, a portion of said second encircling wall defining a second recess;

said second element has a second pedestal standing in said second recess and spaced apart from said second wall;

said film element extends from said first pedestal to said second pedestal; and said second pedestal is bendable to avoid an overstretching of said film element.

19. A cap according to claim 18, further comprising a first membrane and a second membrane for closing respectively said first recess and said second recess;

wherein said first membrane has a thickness less than a thickness of said first pedestal and extends from said first pedestal to said first wall; and said second membrane has thickness less than a thickness of said second pedestal and extends from said second pedestal to said second wall.

* * * * *